US012680219B2

(12) United States Patent
Vargas et al.

(10) Patent No.: US 12,680,219 B2
(45) Date of Patent: Jul. 14, 2026

(54) ENERGY HARVESTING SYSTEM USING DRYER EXHAUST AIR TO GENERATE ELECTRICITY

(71) Applicant: Whirlpool Corporation, Benton Harbor, MI (US)

(72) Inventors: Victor Vargas, Stevensville, MI (US); Brent M. Burgess, Edwardsburg, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 643 days.

(21) Appl. No.: 18/132,118

(22) Filed: Apr. 7, 2023

(65) Prior Publication Data

US 2024/0337064 A1 Oct. 10, 2024

(51) Int. Cl.

| | |
|---|---|
| ***D06F 58/10*** | (2006.01) |
| ***D06F 58/22*** | (2006.01) |
| ***D06F 103/44*** | (2020.01) |
| ***D06F 105/60*** | (2020.01) |
| ***F01N 5/04*** | (2006.01) |

(52) U.S. Cl.

CPC ..... *D06F 58/10* (2013.01); *D06F 58/22* (2013.01); *F01N 5/04* (2013.01); *D06F 2103/44* (2020.02); *D06F 2105/60* (2020.02)

(58) Field of Classification Search

CPC ..... D06F 58/10; D06F 58/22; D06F 2105/60; D06F 2103/44; F01N 5/04

USPC ..... 34/523, 595–610

See application file for complete search history.

(56) References Cited

U.S. PATENT DOCUMENTS

| | | | | |
|---|---|---|---|---|
| 3,203,679 A * | 8/1965 | Williams | ..... | D06F 34/08 432/44 |
| 4,797,656 A * | 1/1989 | Keppler | ..... | D06F 34/05 340/602 |
| 5,899,005 A * | 5/1999 | Chen | ..... | D06F 58/38 34/535 |
| 7,234,325 B2 * | 6/2007 | McAllister | ..... | D06F 33/36 68/133 |
| 8,156,660 B2 * | 4/2012 | Carow | ..... | D06F 58/38 200/16 R |

(Continued)

FOREIGN PATENT DOCUMENTS

| | | | | |
|---|---|---|---|---|
| AU | 2020377396 A1 * | 5/2022 | ..... | D06F 1/02 |
| CN | 103133247 A | 6/2013 | | |

(Continued)

OTHER PUBLICATIONS

Article from the International Research Journal of Engineering and Technology (IRJET) entitled: Generation of Electricity From Exhausted Air; dated May 2018 (6 Pages).

*Primary Examiner* — Stephen M Gravini

(74) *Attorney, Agent, or Firm* — Brooks Kushman P.C.

(57) ABSTRACT

A vented dryer includes a cabinet, a drum, a heater, and an energy harvesting system. The cabinet has an exhaust outlet and a cabinet inlet. The drum is rotatably supported within the cabinet and includes a laundry compartment positioned inside the drum. The heater heats a flow of air that travels through the drum and exits out the exhaust outlet. The energy harvesting system includes a turbine wheel that is rotatably coupled to a turbine wheel motor to recover mechanical energy from the flow of air exiting through the exhaust outlet of the cabinet and convert the recovered mechanical energy into electricity.

20 Claims, 9 Drawing Sheets

(56) References Cited

U.S. PATENT DOCUMENTS

| | | | | |
|---|---|---|---|---|
| 9,134,068 | B2 * | 9/2015 | Choi | F26B 23/001 |
| 9,783,925 | B1 * | 10/2017 | Pollett | D06F 58/45 |
| 10,184,208 | B2 * | 1/2019 | Rizzi | D06F 58/38 |
| 12,252,837 | B2 * | 3/2025 | Reeves | D06F 58/38 |
| 12,435,461 | B2 * | 10/2025 | Kim | A61L 2/26 |
| 2023/0250570 | A1 * | 8/2023 | Farakte | D06F 19/00 8/159 |
| 2024/0337064 | A1 * | 10/2024 | Vargas | D06F 39/30 |
| 2025/0179708 | A1 * | 6/2025 | Wang | A47L 15/02 |

FOREIGN PATENT DOCUMENTS

| | | | | |
|---|---|---|---|---|
| CN | 204112089 | U | 1/2015 | |
| CN | 212025707 | U | 11/2020 | |
| EP | 3868949 | A1 * | 8/2021 | D06F 39/085 |
| JP | 5645244 | B2 | 12/2014 | |
| WO | WO-2021087545 | A1 * | 5/2021 | D06F 1/02 |

* cited by examiner

ENERGY HARVESTING SYSTEM USING DRYER EXHAUST AIR TO GENERATE ELECTRICITY

FIELD

The present disclosure relates to an energy harvesting system, and more specifically an energy harvesting system using dryer exhaust air to generate electricity.

BACKGROUND

This section provides background information related to the present disclosure which is not necessarily prior art.

Laundry appliances are prolific in both residential and commercial settings. The laundry appliance may be a dryer machine that is used to dry laundry after it has been cleaned in a washing machine. In some examples, the laundry appliance may be a washer and dryer combination appliance where a single machine performs both the washing and drying functions. There are a number of different names used to describe washer and dryer combination appliances, including without limitation, "washer/dryer combos" and "all-in-one washer dryers."

Many laundry appliances include a cabinet (i.e., an appliance housing) with an opening that is accessed by an appliance door. A drum is positioned in the cabinet and is rotatable with respect to the cabinet. The drum typically has a drum opening that provides access to a laundry compartment inside the drum.

A significant amount of electricity is required to operate the laundry appliance. In traditional laundry appliances, the laundry appliance is powered using only one electrical source. For example, the laundry appliance is connected to an electrical outlet in a wall of the building and receives power from an electrical supply of the building. However, consuming all of the electricity needed to operate the laundry appliance from one external electrical supply yields a high electrical bill for customers. Solutions that reduce the amount of electricity used from the external electrical supply of the building in face of these challenges are needed.

SUMMARY

This section provides a general summary of the disclosure, and is not a comprehensive disclosure of its full scope or all of its features.

In accordance with one aspect of the present disclosure, a vented dryer is provided that comprises a cabinet, a drum, a heater, and an energy harvesting system. The cabinet has an exhaust outlet and a cabinet inlet. The drum is rotatably supported within the cabinet and includes a laundry compartment positioned inside the drum. The heater is for heating a flow of air that travels through the drum and exits out the exhaust outlet. The energy harvesting system includes a turbine wheel that is rotatably coupled to a turbine wheel motor to recover mechanical energy from the flow of air exiting through the exhaust outlet of the cabinet and convert the recovered mechanical energy into electricity.

In accordance with another aspect of the present disclosure, the vented dryer further comprises an exhaust system. The exhaust system includes an exhaust inlet arranged in fluid communication with the laundry compartment of the drum. The exhaust system includes an exhaust fan housing and an exhaust fan positioned within the exhaust fan housing. The exhaust fan pulls air into the exhaust inlet from the laundry compartment of the drum and pushes air out the exhaust outlet.

In accordance with another aspect of the present disclosure, the exhaust fan housing includes a recess and the turbine wheel is positioned within the recess.

In accordance with another aspect of the present disclosure, the turbine wheel is positioned between the exhaust fan and the exhaust outlet.

In accordance with another aspect of the present disclosure, the turbine wheel is positioned at least partially below the exhaust fan housing.

In accordance with another aspect of the present disclosure, the turbine wheel is positioned such that the flow of air contacts at least one turbine blade of the turbine wheel, causing the turbine wheel to rotate and rotation of the turbine wheel recovers mechanical energy from the flow of air exiting through the exhaust outlet.

In accordance with another aspect of the present disclosure, the turbine wheel has a rotational axis that is perpendicular to a direction of the flow of air exiting through the exhaust outlet.

In accordance with another aspect of the present disclosure, the turbine wheel is positioned at least partially within the flow of air exiting through the exhaust outlet.

In accordance with another aspect of the present disclosure, the turbine wheel is attached to the turbine wheel motor using a shaft that extends between the turbine wheel and the turbine wheel motor.

In accordance with yet another aspect of the present disclosure, a laundry appliance is provided that comprises a cabinet, a drum, an exhaust system, and an energy harvesting system. The cabinet includes a cabinet inlet. The drum is rotatably supported within the cabinet and includes a laundry compartment positioned inside the drum. The exhaust system includes an exhaust inlet arranged in fluid communication with the laundry compartment of the drum and an exhaust outlet. A flow of air travels through the laundry compartment, through the exhaust system and exits out the exhaust outlet. The energy harvesting system includes a turbine wheel that is rotatably coupled to a turbine wheel motor to recover mechanical energy from the flow of air exiting through the exhaust outlet and convert the recovered mechanical energy into electricity.

In accordance with another aspect of the present disclosure, the exhaust system includes an exhaust fan housing and an exhaust fan positioned within the exhaust fan housing.

In accordance with another aspect of the present disclosure, the energy harvesting system includes a bracket that has a first bracket portion attached to the exhaust fan housing and a second bracket portion attached to the turbine wheel motor.

In accordance with another aspect of the present disclosure, the first bracket portion of the bracket includes a bracket recess that at least partially houses the turbine wheel, such that the turbine wheel is positioned at least partially within the flow of air exiting through the exhaust outlet.

In accordance with another aspect of the present disclosure, the turbine wheel is positioned between the exhaust fan and the exhaust outlet.

In accordance with another aspect of the present disclosure, the flow of air contacts at least one of a plurality of turbine blades of the turbine wheel and causes the turbine wheel to rotate.

In accordance with another aspect of the present disclosure, the energy harvesting system includes a shaft coupling the turbine wheel and the turbine wheel motor such that rotation of the turbine wheel causes the shaft to rotate and rotation of the shaft causes the turbine wheel motor to convert the rotation into electricity.

In accordance with yet another aspect of the present disclosure, a laundry appliance is provided and comprises a cabinet, a drum, an exhaust system, and an energy harvesting system. The cabinet has an exhaust outlet and a cabinet inlet. The drum is rotatably supported within the cabinet and includes a laundry compartment positioned within the drum. The exhaust system has a removable lint screen positioned between the laundry compartment and the exhaust outlet. A flow of air travels through the laundry compartment, through the removable lint screen of the exhaust system and exits out the exhaust outlet. The energy harvesting system includes a turbine wheel that is rotatably coupled to a turbine wheel motor to recover mechanical energy from the flow of air exiting through the exhaust outlet of the cabinet and convert the recovered mechanical energy into electric current.

In accordance with yet another aspect of the present disclosure, the laundry appliance further comprises a control module that has a processor and memory. The control module is programmed to determine a voltage of the electric current converted from the recovered mechanical energy and determine an amount of lint in the exhaust system based on the voltage of the electric current converted from the recovered mechanical energy.

In accordance with yet another aspect of the present disclosure, the control module is programmed to send an alert when the amount of lint exceeds a threshold amount of lint using at least one of a display and a speaker.

In accordance with yet another aspect of the present disclosure, the electric current is used to power at least one electrical component of the laundry appliance.

Advantageously, the laundry appliance described herein is capable of recovering mechanical energy from a flow of air exiting an exhaust outlet and converting the recovered mechanical energy into electric current in order to power at least one electrical component of the laundry appliance. This design efficiently utilizes the flow of air exiting the exhaust outlet and thereby, reduces an amount of electricity used from an external electrical supply.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
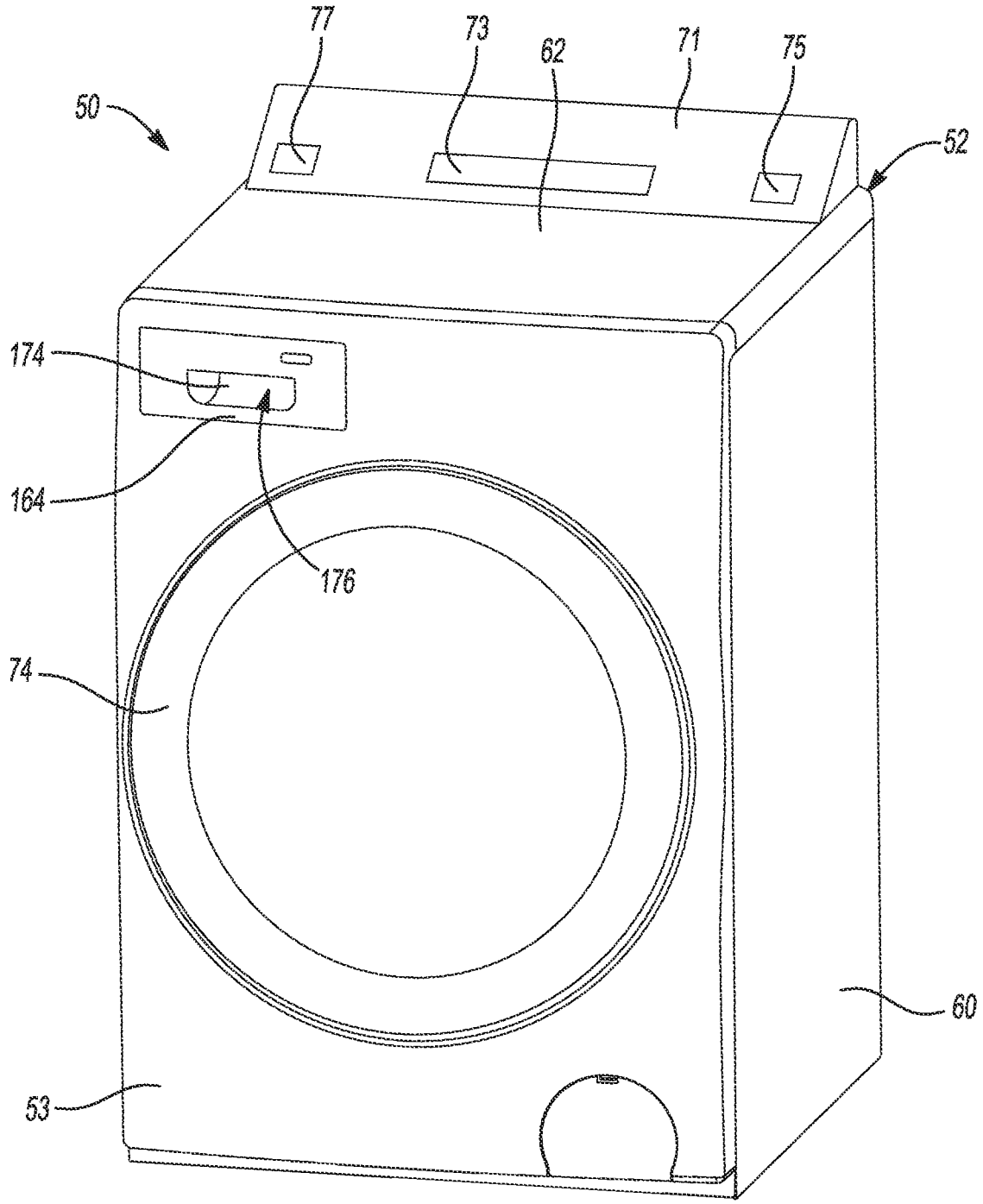
FIG. 1 is a front perspective view of a laundry appliance constructed in accordance with the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
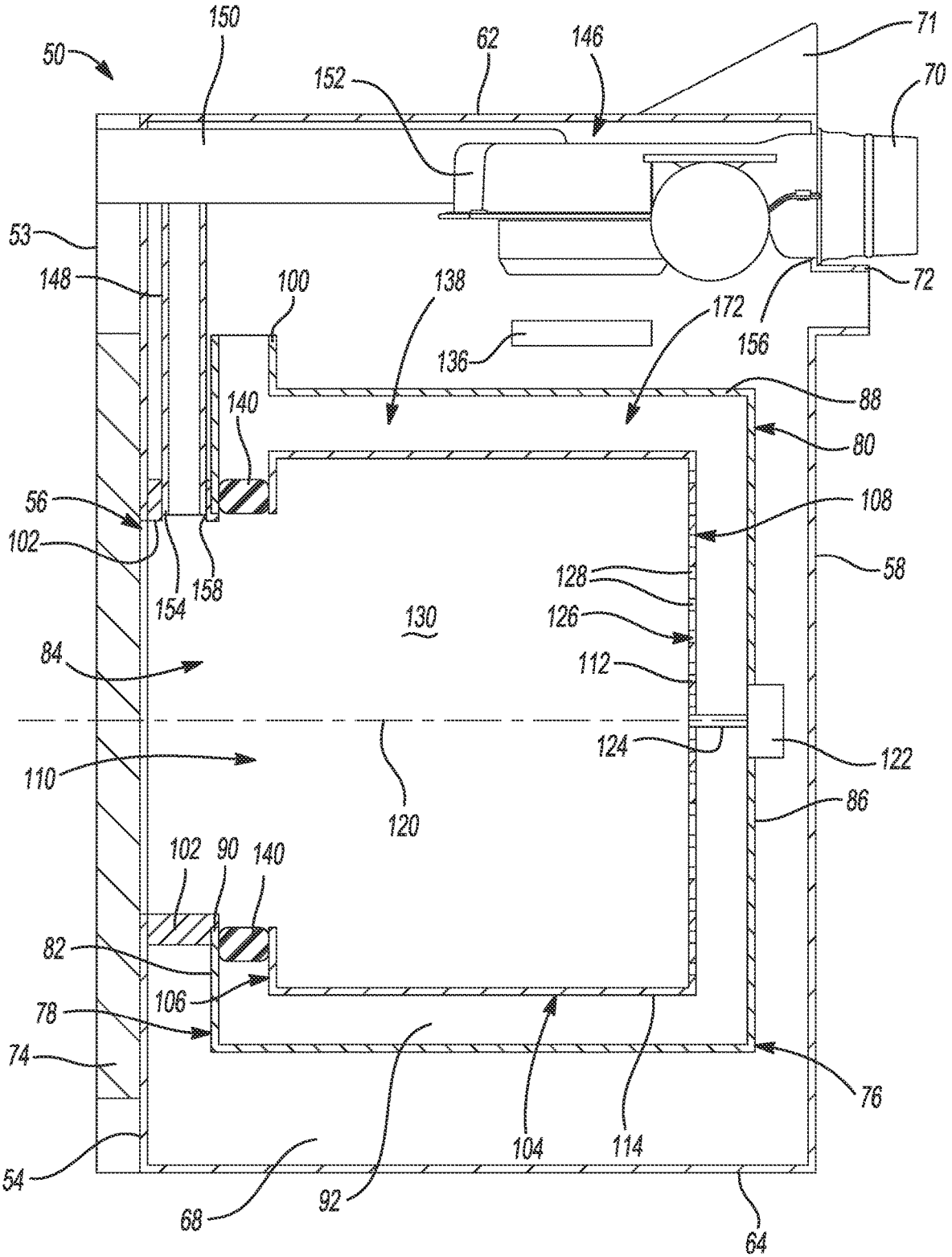
FIG. 2 is a side cross-sectional view of the exemplary laundry appliance shown in FIG. 1.

With reference to FIGS. 1 and 2, a laundry appliance 50 is illustrated. The laundry appliance 50 is as a combination washer-dryer machine. However, it should be appreciated that the laundry appliance 50 may be any vented dryer. Additionally, the laundry appliance 50 is illustrated as having a front-load configuration, though may alternatively have a top-load configuration.

The laundry appliance 50 includes a cabinet 52 that is rectangular in shape and a front facia 53 attached to the cabinet 52. The cabinet 52 includes a front cabinet wall 54 having a front cabinet opening 56, a rear cabinet wall 58 opposite the front cabinet wall 54, a set of cabinet sidewalls 60 that extend between the front cabinet wall 54 and the rear cabinet wall 58, a top cabinet wall 62, and a bottom cabinet wall 64. The front cabinet wall 54, rear cabinet wall 58, set of cabinet sidewalls 60, top cabinet wall 62, and bottom cabinet wall 64 cooperate to define a cabinet cavity 68 inside the cabinet 52. In the illustrated example, an exhaust outlet 70 extends through the rear cabinet wall 58 and is positioned adjacent to the top cabinet wall 62. However, the exhaust outlet 70 may extend through the rear cabinet wall 58, the set of cabinet sidewalls 60 or the bottom cabinet wall 64 and may be positioned adjacent to the top cabinet wall 62 or the bottom cabinet wall 64. A cabinet inlet 72 extends through the rear cabinet wall 58. In the illustrated example, the cabinet inlet 72 is positioned below the exhaust outlet 70. However, the cabinet inlet 72 may be in another position relative to the exhaust outlet 70, such as beside the exhaust outlet 70. Air enters the cabinet 52 via the cabinet inlet 72 and air exits the cabinet 52 via the exhaust outlet 70.

In some configurations, the laundry appliance 50 may include a control panel 71 that is attached to the top cabinet wall 62. The control panel 71 may be positioned adjacent to the rear cabinet wall 58. The control panel 71 may include a display 73, a speaker 75, and a control module 77. The display 73 may be used to display information, adjust features or settings of the laundry appliance 50, present prompts to users of the laundry appliance 50, and to perform one or more other functions. The display 73 may be a touch screen display. The speaker 75 may be used to output audible sounds and to perform one or more functions. The control module 77 may receive input from the user (e.g., via the display 73). The control module 77 may be configured to operate a cycle (e.g., wash cycle, dry cycle) of the laundry appliance 50 according to the user's input and may perform one or more functions. It should be appreciated that the display 73, speaker 75, and control module 77 may be positioned in another suitable location of the laundry appliance 50, such as attached to the front facia 53 of the laundry appliance 50.

A front appliance door 74 is pivotally connected to the cabinet 52, and more specifically, the front cabinet wall 54. The front appliance door 74 swings between an open position and a closed position. In the closed position, the front appliance door 74 shuts or closes the front cabinet opening 56. Although other materials can be used, in the illustrated example, the front appliance door 74 is composed of metal. As illustrated in FIG. 2, the front appliance door 74 is flush with the front facia 53. However, the front appliance door 74 may not be flush with the front facia 53 in other configurations.

The laundry appliance 50 includes a tub 76 that is mounted inside the cabinet cavity 68 using one or more suspension elements (not shown). The suspension elements keep the tub 76 from rotating but permit limited degrees of freedom that allow the tub 76 to move/oscillate relative to the cabinet 52 during the operation of the laundry appliance 50. The tub 76 has a substantially cylindrical shape and extends between a front tub end 78 and a rear tub end 80. The tub 76 includes a front tub wall 82 having a front tub opening 84 at the front tub end 78, a rear tub wall 86 at the rear tub end 80, and a tub sidewall 88 that extends between the front and rear tub ends 78, 80. The front tub end 78 includes a rim 90 that extends annularly about the front tub opening 84. The front tub wall 82, rear tub wall 86, and tub sidewall 88 cooperate to define a tub cavity 92 inside the tub 76. Although other materials can be used, in the illustrated example, the tub 76 is composed of steel.

The tub 76 includes a tub inlet 100 that extends through the tub sidewall 88 and is positioned adjacent to the front tub wall 82. The tub inlet 100 is arranged in fluid communication with the cabinet inlet 72. In one example, the tub inlet 100 is arranged in fluid communication with the cabinet cavity 68. Accordingly, air from the cabinet cavity 68 enters the tub inlet 100. In another example, an intake duct (not shown) may extend between the tub inlet 100 and the cabinet inlet 72. Either way, air entering the cabinet inlet 72 is directed to flow into the tub 76 via the tub inlet 100.

A bellows 102 is positioned between the front tub wall 82 and the front cabinet wall 54. The bellows 102 extends annularly about the front tub opening 84 and is attached to the rim 90 of the front tub opening 84. The bellows 102 prevents fluid and laundry inside the tub 76 from entering the cabinet cavity 68.

The laundry appliance 50 includes a drum 104 that is positioned in the tub cavity 92. The drum 104 has a cylindrical shape and extends between a front drum end 106 and a rear drum end 108. The drum 104 includes a front drum opening 110 at the front drum end 106, a rear drum wall 112 at the rear drum end 108, and a drum sidewall 114 that extends between the front and rear drum ends 106, 108.

The drum 104 is supported within the tub cavity 92 and is rotatable with respect to the tub 76 about an axis 120. An electric motor 122 is positioned within the cabinet 52. More specifically, the electric motor 122 is attached to the rear tub end 80. The electric motor 122 is connected to a drive shaft 124 that extends from the electric motor 122 to the rear drum end 108 of the drum 104. The drive shaft 124 is aligned with the axis 120. The electric motor 122 operates to drive rotation of the drive shaft 124, which in turn drives rotation of the drum 104 within the tub 76.

A drum inlet 126 extends through the rear drum wall 112 such that the tub cavity 92 and the drum 104 are in fluid communication with each other. The drum inlet 126 includes a plurality of perforations 128 disposed through the rear drum wall 112. In some configurations, the drum inlet 126 may extend through both the rear drum wall 112 and the drum sidewall 114.

The front drum end 106, the drum sidewall 114, and the rear drum wall 112 cooperate to define a laundry compartment 130 inside the drum 104. The laundry compartment 130 is arranged in fluid communication with the tub cavity 92 via the drum inlet 126. The front cabinet opening 56 in the front cabinet wall 54, the front tub opening 84 in the front tub wall 82, and the front drum opening 110 at the front drum end 106 are at least partially aligned with one another and therefore provide access to the laundry compartment 130 inside the drum 104 when the front appliance door 74 is in the open position. In the illustrated example, the front cabinet opening 56 in the front cabinet wall 54, the front tub opening 84 in the front tub wall 82, and the front drum opening 110 at the front drum end 106 are aligned with the axis 120. It should be appreciated that in use, laundry (e.g., clothes, towels, and/or bedding, etc.) is placed inside the laundry compartment 130 where it is first cleaned during the wash cycle and then dried during the drying cycle of the laundry appliance 50.

The laundry appliance 50 includes a heater 136 that is positioned within the cabinet cavity 68. More specifically, the heater 136 is positioned to heat air entering the tub inlet 100 and traveling through the drum 104. The heater 136 is attached to one or more adjacent components using one or more brackets (not shown). An air gap 138 is positioned between the tub 76 and the drum 104. The air gap 138 is arranged in fluid communication with the cabinet cavity 68 via the tub inlet 100. The air gap 138 is arranged in fluid communication with the laundry compartment 130 via the drum inlet 126. The air gap 138 extends between the tub sidewall 88 and the drum sidewall 114 and between the rear tub wall 86 and the rear drum wall 112. A seal 140 extends annularly about the front drum opening 110 and is positioned between the front tub opening 84 and the front drum opening 110. The seal 140 directs air entering through the tub inlet 100 to the air gap 138.

The laundry appliance 50 includes an exhaust system 146 that includes an exhaust duct 148, a removable lint screen assembly 150, an exhaust fan assembly 152. The exhaust system 146 extends between a first exhaust end 154 (e.g., exhaust inlet) and a second exhaust end 156 (e.g., second exhaust outlet). The first exhaust end 154 is arranged in fluid communication with the laundry compartment 130. The second exhaust end 156 is arranged in fluid communication with the exhaust outlet 70.

The exhaust duct 148 extends between the first exhaust end 154 and the removable lint screen assembly 150. The first exhaust end 154 is secured to the bellows 102. A first exhaust port 158 extends through the bellows 102 and is arranged in fluid communication with the first exhaust end 154. Accordingly, the first exhaust end 154 is arranged in fluid communication with the laundry compartment 130, the front drum opening 110, and the front tub opening 84 via the first exhaust port 144 in the bellows 102. The exhaust duct 148 is illustrated as a linear duct. It should be appreciated that the exhaust duct 148 may be formed in any suitable shape, such as a curved duct.

Figure 3:
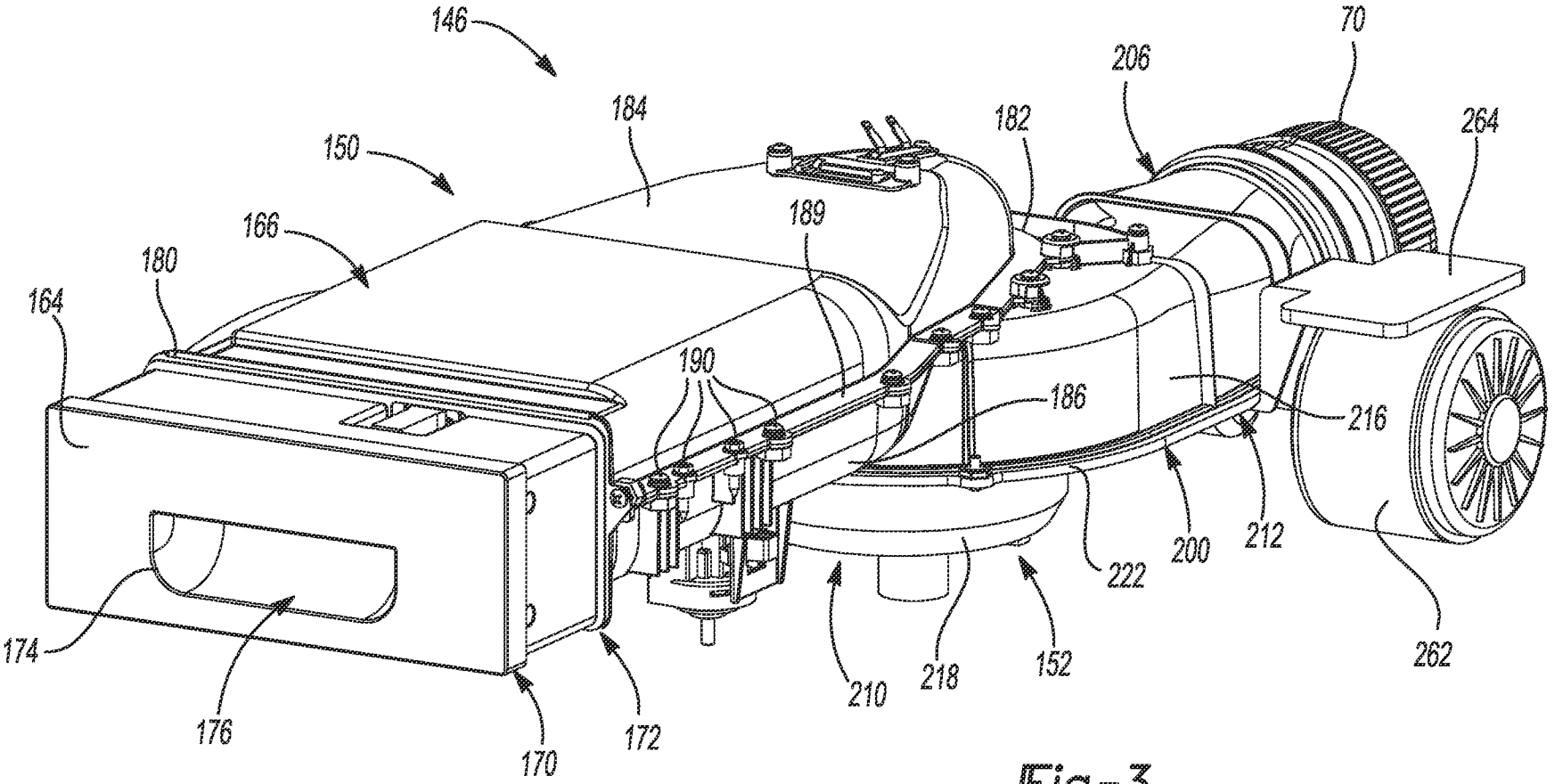
FIG. 3 is a front perspective view of an exhaust system of the exemplary laundry appliance shown in FIGS. 1-2.
Figure 4:
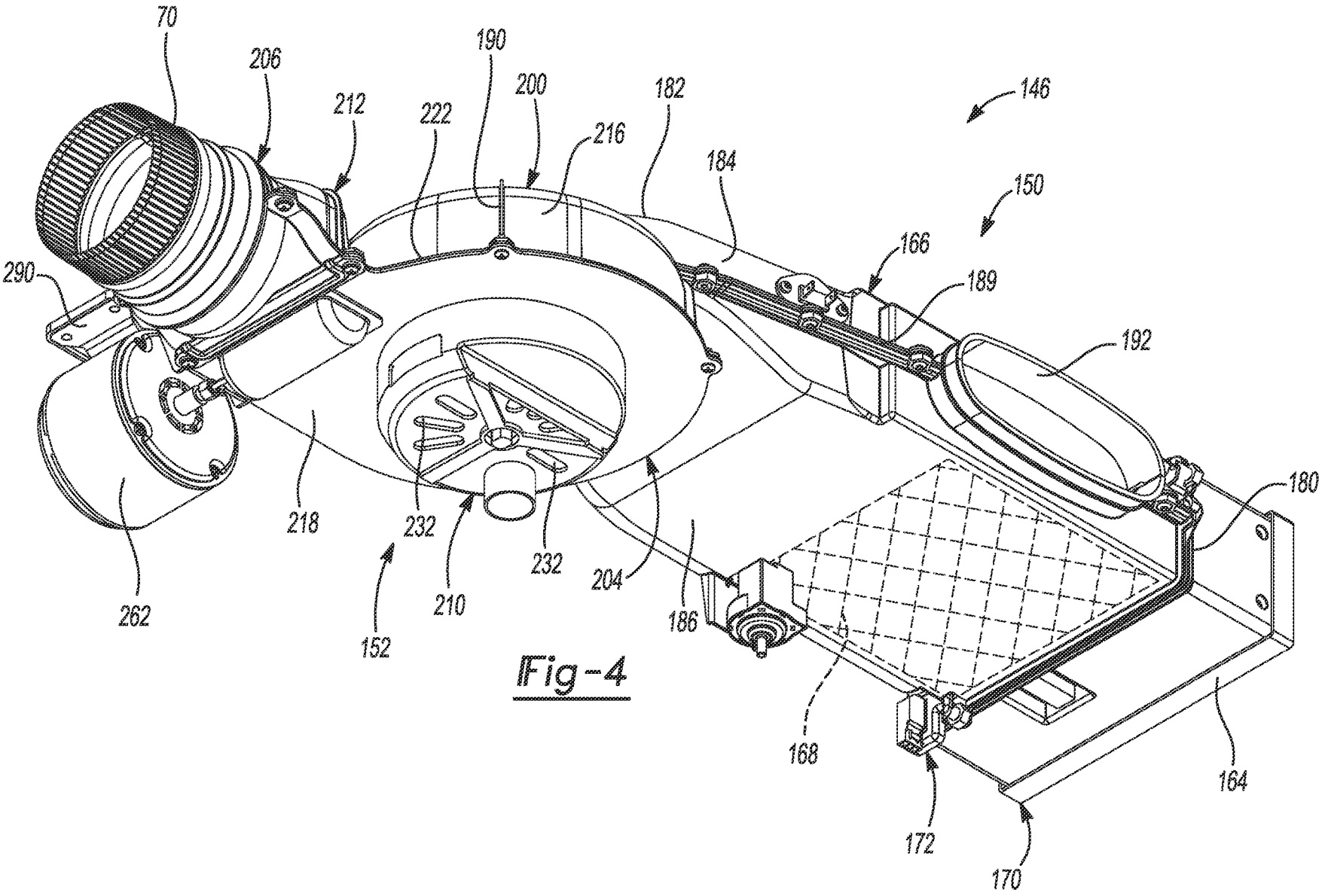
FIG. 4 is a rear perspective view of the exemplary exhaust system shown in FIG. 3.
Figure 5:
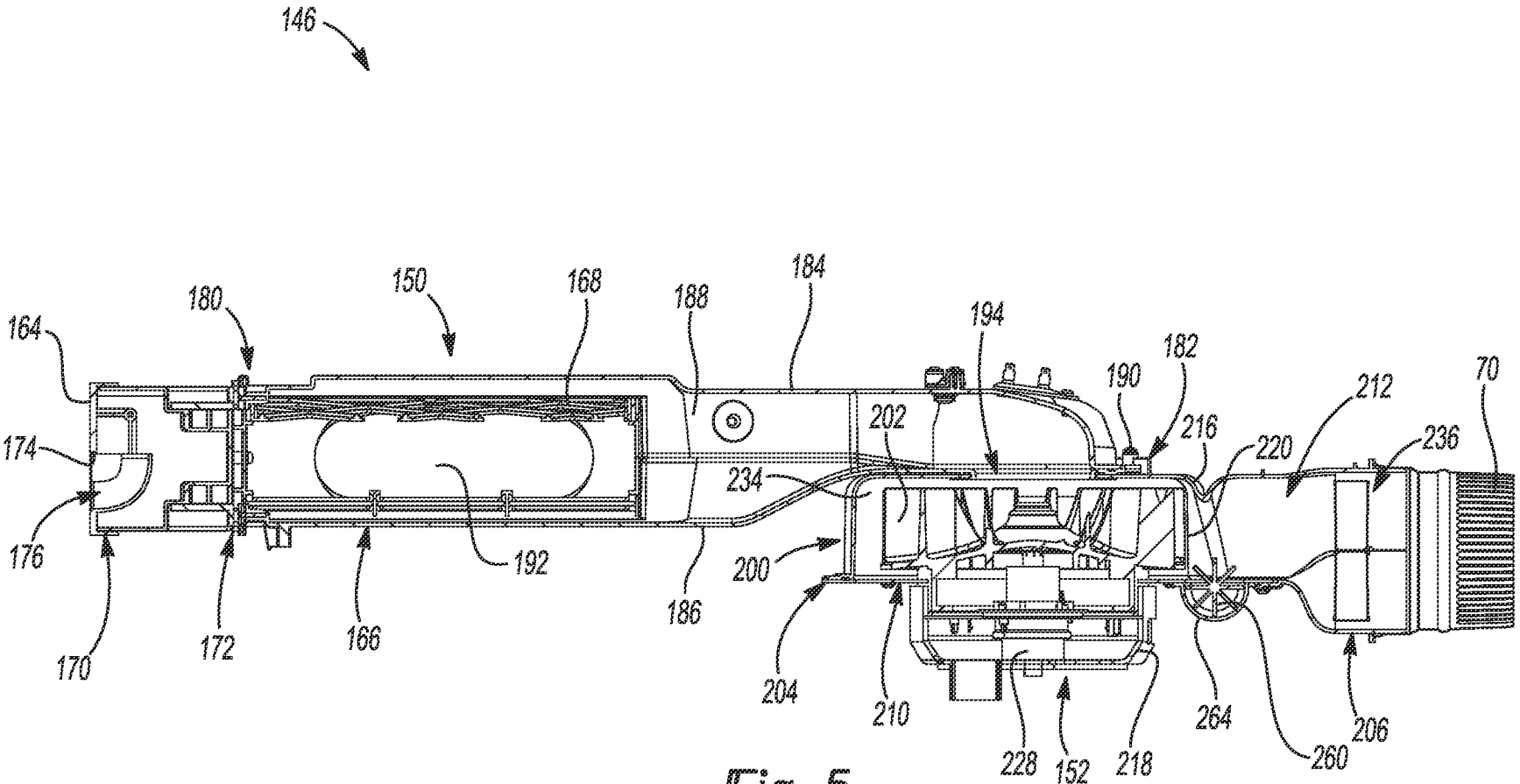
FIG. 5 is a side cross-sectional view of the exemplary exhaust system shown in FIGS. 3-4.

With additional reference to FIGS. 3-5, the removable lint screen assembly 150 includes a lint screen door 164, a lint screen housing 166, and a removable lint screen 168. The lint screen door 164 is disposed within the front cabinet wall 54 of the cabinet 52. The lint screen door 164 extends between a front door end 170 and a rear door end 172. The front door end 170 of the lint screen door 164 is positioned adjacent to or flush with the front facia 53 of the laundry appliance 50. The rear door end 172 of the lint screen door 164 is attached to the removable lint screen 168. The lint screen door 164 includes a handle 174 that is used to move the removable lint screen 168 into and out of the laundry appliance 50. In the illustrated example, the handle 174 is a pull cup type handle that has a recess 176 in the lint screen door 164. It can be appreciated that another suitable type of handle 174 may be used.

The lint screen housing 166 extends between a first lint screen housing end 180 and a second lint screen housing end 182. The first lint screen housing end 180 is coupled to the lint screen door 164. The second lint screen housing end 182 is attached to the exhaust fan assembly 152. Additionally, the lint screen housing 166 includes a first housing panel 184 and a second housing panel 186. The first housing panel 184 is positioned adjacent to the top cabinet wall 62. The second housing panel 186 is positioned below the first housing panel 184. The first and second housing panels 184, 186 cooperate to define the lint screen housing cavity 188 inside the lint screen housing 166. More specifically, the first and second housing panels 184, 186 are arranged in a clamshell configuration and the lint screen housing cavity is formed between the first and second housing panels 184, 186. The first and second housing panels 184, 186 are secured together along a perimeter rim 189 of the lint screen housing 166 using mechanical fasteners 190. In some examples, the lint screen housing 166 may be composed of a single component.

The lint screen housing 166 includes a lint screen housing inlet 192 and a lint screen housing outlet 194. The lint screen housing inlet 192 is positioned adjacent to the first lint screen housing end 180. The lint screen housing inlet 192 extends through the first and second housing panels 184, 186. The lint screen housing inlet 192 is formed when the first and second housing panels 184, 186 are attached together. The lint screen housing cavity 188 is arranged in fluid communication with the exhaust duct 148 via the lint screen housing inlet 192. In other words, air flow travels from the exhaust duct 148 into the lint screen housing cavity 188 via the lint screen housing inlet 192. The lint screen housing outlet 194 is positioned adjacent to the second lint screen housing end 182 and extends through the second housing panel 186. The lint screen housing cavity 188 is arranged in the fluid communication with the exhaust fan assembly 152 via the lint screen housing outlet 194. In other words, air flow travels from the lint screen housing cavity 188 into the exhaust fan assembly 152 via the lint screen housing outlet 194.

In the illustrated example, the removable lint screen 168 is positioned adjacent to the top cabinet wall 62 and front cabinet wall 54. More specifically, the removable lint screen 168 is positioned within the lint screen housing cavity 188 at the first lint screen housing end. However, the removable lint screen 168 may be positioned in another suitable location of the laundry appliance 50. The removable lint screen 168 is attached to the lint screen door 164 opposite to the handle 174 of the lint screen door 164 such that it has a drawer-like configuration. The removable lint screen 168 is removable from the lint screen housing 166 and can be cleaned or replaced. For example, a user may pull the handle 174 of the lint screen door 164 to remove the removable lint screen 168 from the lint screen housing 166 and may re-insert the removable lint screen 168 into the lint screen housing 166. However, the removable lint screen 168 may have another suitable configuration.

The removable lint screen 168 is positioned adjacent to the lint screen housing inlet 192. Air and lint may flow from the laundry compartment 130, through the exhaust duct 148, into the lint screen housing inlet 192, and to the removable lint screen 168. Air is able to pass through the removable lint screen 168 from the exhaust duct 148, through the lint screen housing cavity 188, and to the exhaust fan assembly 152. However, lint is trapped in the removable lint screen 168. Accordingly, lint is collected within and on the removable lint screen 168.

Figure 6:
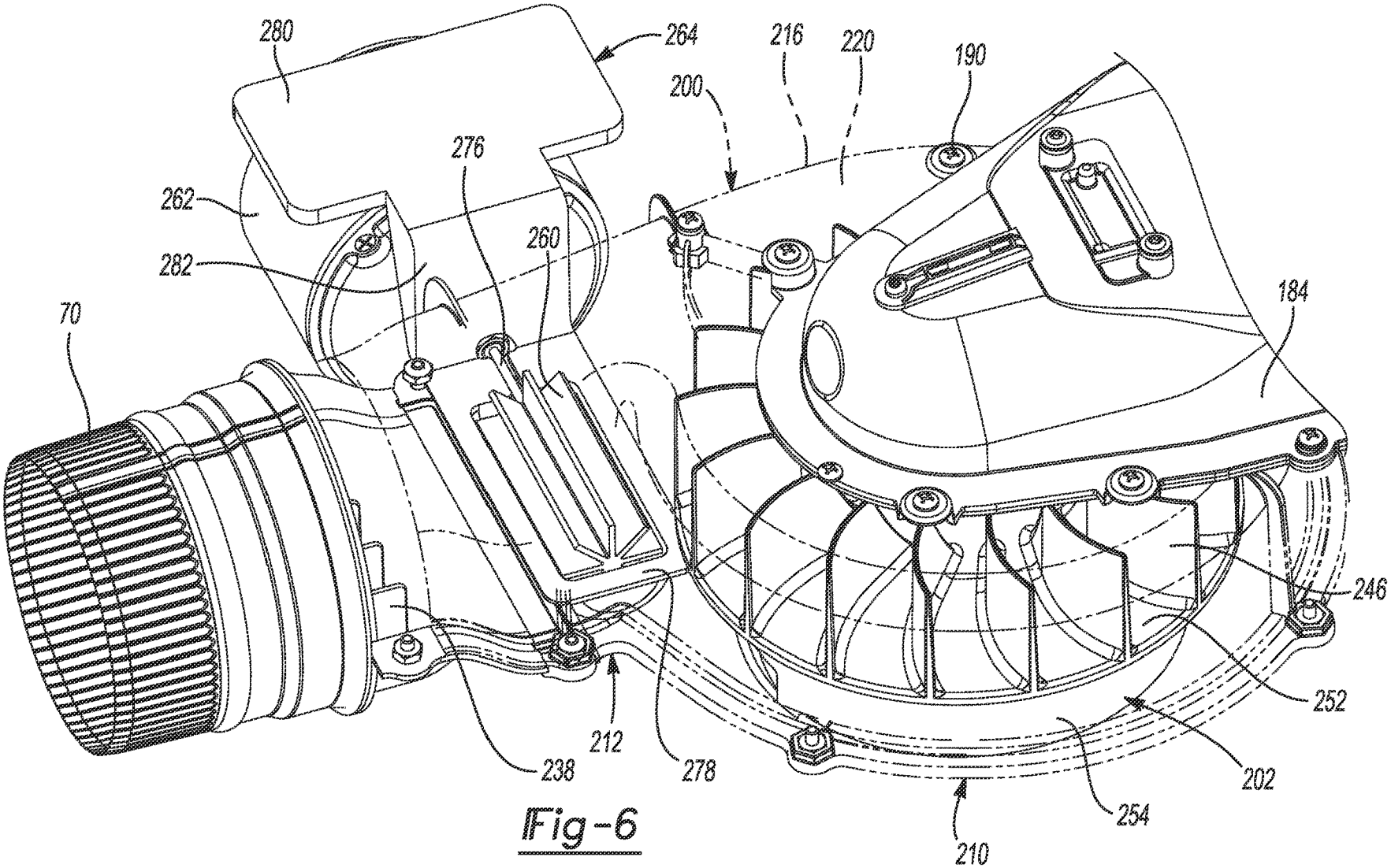
FIG. 6 is an enlarged rear perspective view of an energy harvesting system of the exemplary laundry appliance shown in FIGS. 1-2.
Figure 7:
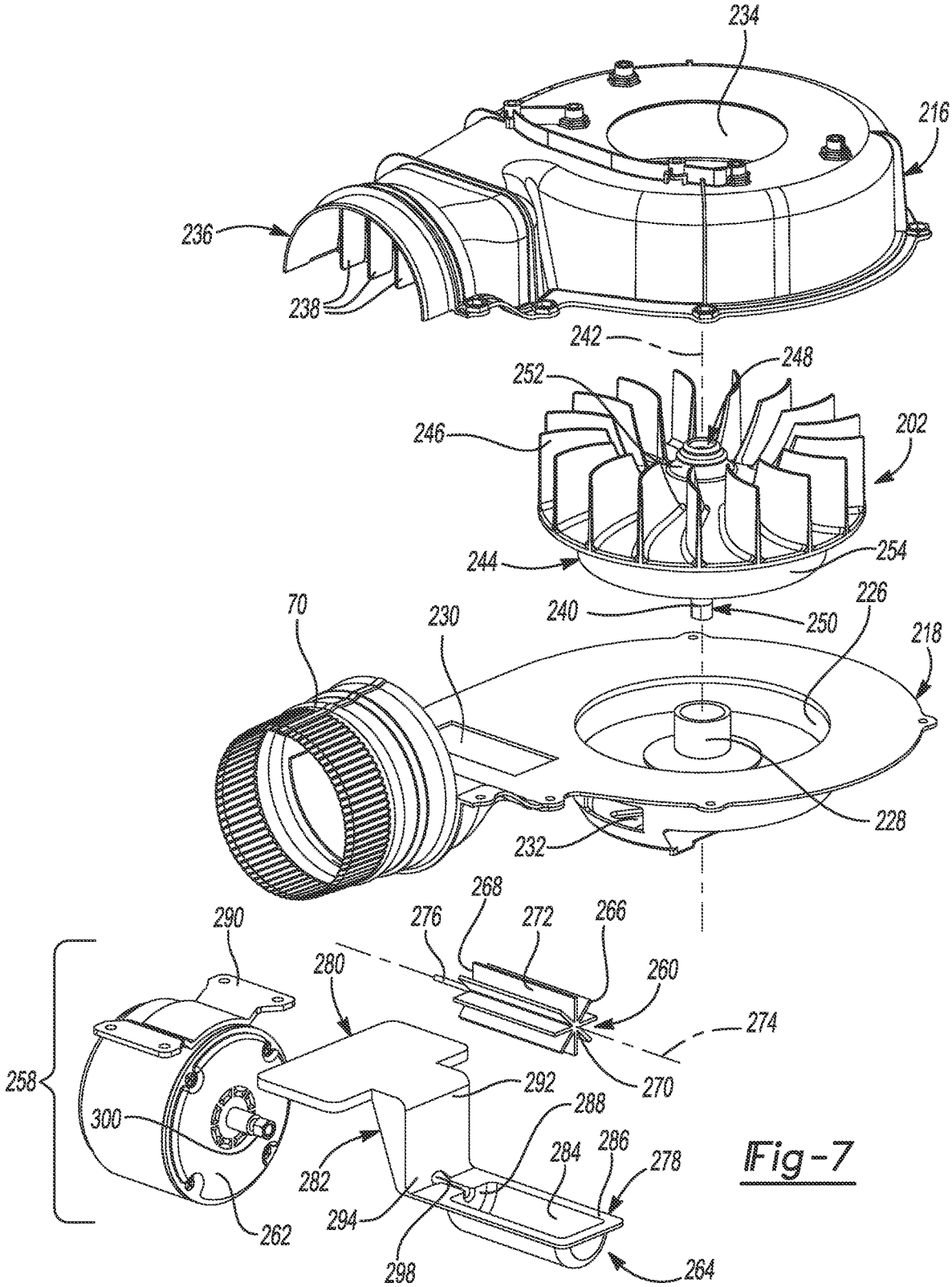
FIG. 7 is an exploded view of the exemplary energy harvesting system shown in FIG. 6.

With reference to FIGS. 5-7, the exhaust fan assembly 152 includes an exhaust fan housing 200 and an exhaust fan 202. The exhaust fan housing 200 extends between a first exhaust fan housing end 204 and a second exhaust fan housing end 206. The first exhaust fan housing end 204 is positioned adjacent to the removable lint screen assembly 150. The second exhaust fan housing end 206 is positioned adjacent to the exhaust outlet 70.

The exhaust fan housing 200 includes a first fan portion 210 and a second fan portion 212. The first fan portion 210 is positioned adjacent to the first exhaust fan housing end 204. The first fan portion 210 has a circular shape and houses the exhaust fan 202. However, another suitable shape may be used. The second fan portion 212 is positioned adjacent to the second exhaust fan housing end 206. The second fan portion 212 branches from the first fan portion 210. The second fan portion 212 is formed in a rectangular shape, or another suitable shape.

The exhaust fan housing 200 includes a third housing panel 216 and a fourth housing panel 218. The third housing panel 216 is positioned adjacent to the top cabinet wall 62 and the second lint screen housing end 182 of the removable lint screen assembly 150. The fourth housing panel 218 is positioned below the third housing panel 216. The third and fourth housing panels 216, 218 cooperate to define the exhaust fan housing cavity 220 inside the exhaust fan housing 200. The third and fourth housing panels 216, 218 are secured together along a second perimeter rim 222 of the exhaust fan housing 200 using mechanical fasteners 190. In some examples, the exhaust fan housing 200 may be a single component.

The fourth housing panel 218 includes an exhaust housing recess 226. The exhaust housing recess 226 is formed in a circular shape, or another suitable shape. An exhaust fan motor 228 is disposed within the exhaust housing recess 226.

The fourth housing panel 218 includes a first exhaust housing opening 230 and a plurality of second exhaust fan openings 232. The first exhaust housing opening 230 is positioned adjacent to the second exhaust fan housing end 206. The first exhaust housing opening 230 has a rectangular shape. However, the first exhaust housing opening 230 may have another suitable shape. The plurality of second exhaust fan openings 232 extend through the exhaust housing recess 226 of the fourth housing panel 218. The plurality of second exhaust fan openings 232 is disposed adjacent to the exhaust fan motor 228.

The exhaust fan housing 200 includes an exhaust fan housing inlet 234 and an exhaust fan housing outlet 236. The exhaust fan housing inlet 234 is positioned adjacent to the second lint screen housing end 182 and extends through the third housing panel 208. The exhaust fan housing inlet 234 may be at least partially aligned with lint screen housing outlet 194. The exhaust fan housing cavity 220 is arranged in fluid communication with the lint screen housing cavity 188 via the exhaust fan housing inlet 234. In other words, air flow travels from the lint screen housing cavity 188 into the exhaust fan housing cavity 220 via the lint screen housing outlet 194 and the exhaust fan housing inlet 234. The exhaust fan housing outlet 236 is positioned adjacent to the exhaust outlet 70 and extends through the third and fourth housing panels 216, 218. The exhaust fan housing outlet 236 is formed when the third and fourth housing panels 216, 218 are assembled together. The exhaust fan housing outlet 236 may be received in the exhaust outlet 70. The exhaust fan housing cavity 220 is arranged in the fluid communication with the exhaust outlet 70 via the exhaust fan housing outlet 236. In other words, air flow travels from the exhaust fan assembly 152 into the exhaust outlet 70 via the exhaust fan housing outlet 236. One or more vanes 238 may be positioned at the exhaust fan housing outlet 236. The vanes 238 are spaced apart from each other and positioned in a parallel configuration.

The exhaust fan 202 is positioned within the exhaust fan housing cavity 220. The exhaust fan 202 is connected to an exhaust fan shaft 240 that extends from the exhaust fan 202 and is received in the exhaust fan motor 228. The exhaust fan motor 228 operates to drive rotation of the exhaust fan 202 about the exhaust fan axis 242. The exhaust fan 202 rotates in a counter-clockwise direction when viewed from above the exhaust fan 202. The exhaust fan 202 includes an exhaust fan base 244 and a plurality of fan blades 246.

The exhaust fan base 244 extends between a first fan base end 248 and a second fan base end 250. The first fan base end 248 is positioned adjacent to the exhaust fan housing inlet 234. The second fan base end 250 is positioned within the exhaust housing recess 226 and more specifically, received within the exhaust fan motor 228. The exhaust fan shaft 240 is disposed at the second fan base end 250. The exhaust fan base 244 includes a first fan base portion 252 positioned adjacent to the first fan base end 248 and a second fan base portion 254 positioned adjacent to the second fan base end 250. The first fan base portion 252 is formed in a cone shape such that the first fan base end 248 is a tip of the cone shape. The first fan base portion 252 is positioned above the exhaust housing recess 226. The second fan base portion 254 is formed in a cylindrical shape. The second fan base portion 254 is at least partially positioned within the exhaust housing recess 226.

Each of the plurality of fan blades 246 are attached to the exhaust fan base 244. More specifically, each of the plurality of fan blades 246 are attached to the second fan base portion 254 of the exhaust fan base 244. The plurality of fan blades 246 are annularly spaced apart from each other. Each of the plurality of fan blades 246 are arc-shaped. However, each of the plurality of fan blades 246 may be another suitable shape, such as a propeller shape. The plurality of fan blades 246 may include seventeen fan blades, or another suitable number of fan blades.

The exhaust fan 202 pulls air in from the laundry compartment 130 and into the exhaust duct 148 via first exhaust end 154. The exhaust fan 202 pushes air out the exhaust fan housing 200 via the exhaust fan housing outlet 236 and the exhaust outlet 70 of the cabinet 52. More specifically, the exhaust fan 202 pulls air from the laundry compartment 130 and air flows through the front drum opening 110, through front tub opening 84, through the exhaust duct 148, then through lint screen housing cavity 188 of the lint screen housing 166, and into exhaust fan housing cavity 220 of the exhaust fan housing 200. The exhaust fan 202 pushes air through the exhaust fan housing cavity 220 of the exhaust fan housing 200 and out the exhaust outlet 70. In the illustrated example, the exhaust fan 202 is positioned adjacent to the top cabinet wall 62. However, the exhaust fan 202 may be positioned in other locations within the cabinet cavity 68.

The laundry appliance 50 includes an energy harvesting system 258. The energy harvesting system 258 includes a turbine wheel 260, a turbine wheel motor 262, and a bracket 264. The turbine wheel 260 is disposed within the first exhaust housing opening 230 of the fourth housing panel 218.

The turbine wheel 260 extends between a first wheel end 266 and a second wheel end 268 that opposes the first wheel end 266. The turbine wheel 260 includes a core 270 and a plurality of turbine blades 272. The core 270 extends longitudinally between the first and second wheel ends 266, 268. The plurality of turbine blades 272 each extend longitudinally between the first and second wheel ends 266, 268 and extends radially outward from the core 270. Each of the plurality of turbine blades 272 are annularly spaced apart from each other about the core 270. In the illustrated example, the plurality of turbine blades 272 includes eight blades and each turbine blade 272 is formed in a rectangular shape. However, the plurality of turbine blades 272 may include another suitable number of turbine blades 272 and may be formed in another suitable shape, such as a curved shape.

The turbine wheel 260 rotates about a second rotational axis 274 of the turbine wheel 260. The second rotational axis 274 is positioned approximately perpendicular a direction of air exiting out the exhaust outlet 70. The turbine wheel 260 is positioned partially above the first exhaust housing opening 230 and partially below the first exhaust housing opening 230. In some configurations, the turbine wheel 260 may be positioned within the exhaust fan housing cavity 220 and the second rotational axis 274 of the turbine wheel 260 may be aligned with a direction of air exiting out the exhaust outlet 70.

The turbine wheel motor 262 is coupled to the turbine wheel 260 using a turbine wheel shaft 276. More specifically, the turbine wheel shaft 276 is received within the turbine wheel motor 262 and the core 270 of the turbine wheel 260 at opposing ends. Rotation of the turbine wheel 260 about the second rotational axis 274 causes the turbine wheel shaft 276 to rotate. Rotation of the turbine wheel shaft 276 causes rotates at least one component within the turbine wheel motor 262. Accordingly, rotation of the turbine wheel shaft 276 causes the turbine wheel motor 262 to convert the rotation into electricity. The turbine wheel motor 262 may be formed of a metal, such as iron, or another suitable material.

The bracket 264 includes a first bracket portion 278, a second bracket portion 280, and a third bracket portion 282. The first bracket portion 278 of the bracket 264 is attached to the fourth housing panel 218 of the exhaust fan housing 200 and positioned below the second fan portion 212 of the exhaust fan housing 200. More specifically, the first bracket portion 278 is at least partially aligned with the first exhaust housing opening 230 and attached to the first exhaust housing opening 230. The first bracket portion 278 includes a bracket recess 284. The turbine wheel 260 is positioned at least partially within the bracket recess 284 and at least partially above the fourth housing panel 218. The bracket recess 284 is shaped and sized to allow the turbine wheel 260 to rotate within the bracket recess 284. In the illustrated example, the bracket recess 284 extends longitudinally between a first bracket recess end 286 and a second bracket recess end 288. The bracket recess 284 has a semi-circular cross-sectional shape. The first bracket recess end 286 is positioned adjacent to the first wheel end 266 of the turbine wheel 260. The second bracket recess end 288 is positioned adjacent to the second wheel end 268. However, the bracket recess 284 may be formed in another suitable shape.

In some configurations, the bracket 264 may be integral with the exhaust fan housing 218 such that the first exhaust housing opening 230 and the bracket recess 284 are formed in the exhaust fan housing 218.

The second bracket portion 280 is attached to the turbine wheel motor 262. More specifically, the second bracket portion 280 is disposed on top of the turbine wheel motor 262 and secured to the turbine wheel motor 262 using a second bracket 290. The third bracket portion 282 connects the first and second bracket portions 278, 280. The third bracket portion 282 extends longitudinally between a top bracket end 292 and a bottom bracket end 294. The second bracket portion 280 extends from the top bracket end 292. The first bracket portion 278 extends from the bottom bracket end 294. The first and second bracket portions 278, 280 extend in opposite lateral directions.

A shaft aperture 298 extends through the first and third bracket portions 278, 282 of the bracket 264. The shaft aperture 298 extends through the third bracket portion 282 at the bottom bracket end 294. The shaft aperture 298 extends laterally through the first bracket portion 278 between the third bracket portion 282 and the bracket recess 284 of the first bracket portion 278. The turbine wheel shaft 276 extends through the shaft aperture 298 and is received in a receiver 300 of the turbine wheel motor 262.

Figure 8:
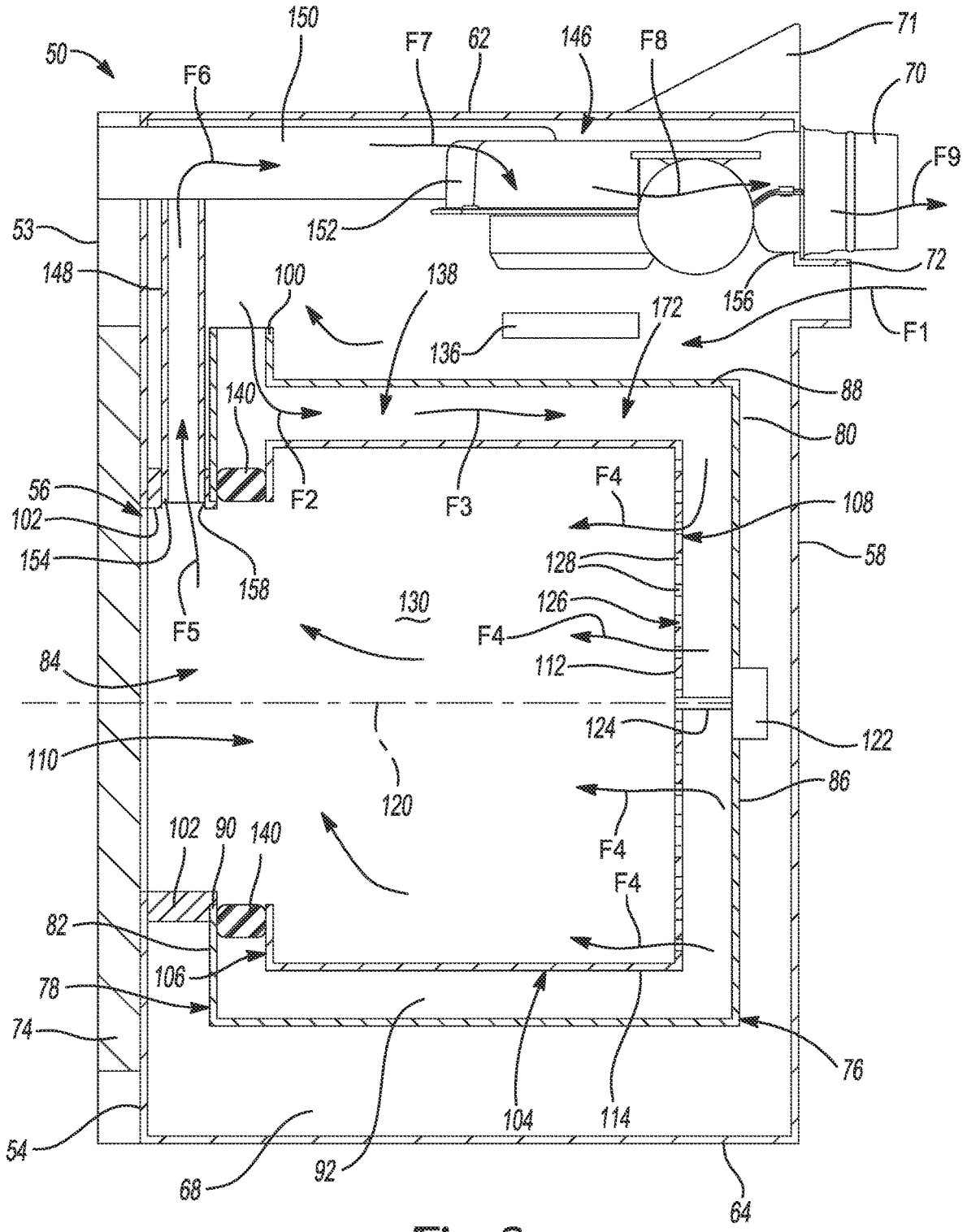
FIG. 8 is a side cross-sectional view of the exemplary laundry appliance shown in FIG. 1, where arrows are included illustrating an air flow path through the laundry appliance.
Figure 9:
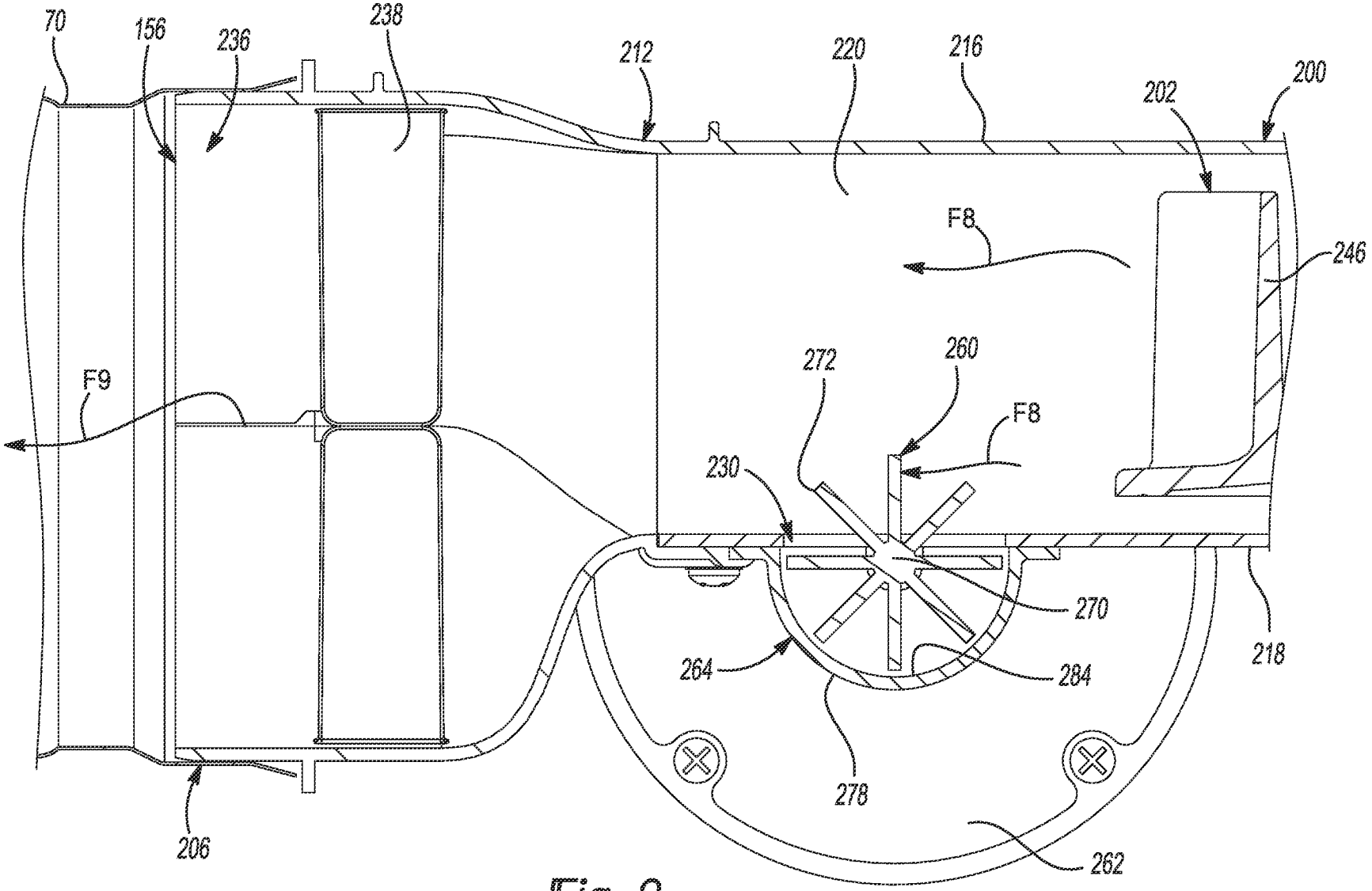
FIG. 9 is an enlarged side cross-sectional view of the exemplary energy harvesting system shown in FIGS. 6-7, where arrows are included to illustrate the air flow path through the energy harvesting system.

With reference to FIGS. 5 and 8-9, an airflow path is defined when the exhaust fan 202 is activated. Air enters the laundry appliance 50 via the cabinet inlet 72 along flow path F1. Air flows from the cabinet inlet 72 though the cabinet cavity 68 and into the tub inlet 100 along flow path F2 and is heated using the heater 136. Air flows from the tub inlet 100 to the rear drum end 108 along flow path F3 via the air gap 138. Air at the rear drum end 108 then flows into the laundry compartment 130 of the drum 104 via the drum inlet 126 along flow path F4. Air in the laundry compartment 130 of the drum 104 flows to the first exhaust end 154 of the exhaust system 146 and the exhaust duct 148 via the first exhaust port 158 along flow path F5. Air in the exhaust duct 148 flows to the lint screen housing cavity 188 of the removable lint screen assembly 150 via the lint screen housing inlet 192 along flow path F6. Air flows from the lint screen housing cavity 188 of the removable lint screen assembly 150 to the exhaust fan housing cavity 220 of the exhaust fan assembly 152 via the lint screen housing outlet 194 and the exhaust fan housing inlet 234 along flow path F7. Air in the exhaust fan housing cavity 220 of the exhaust fan assembly 152 flows to the exhaust fan 202 and air is pushed out from the exhaust fan 202 to the turbine wheel 260 along flow path F8. Air in the second fan portion 212 of the exhaust fan housing 200 flows to the second exhaust end 156 and is released from the laundry appliance 50 via the exhaust outlet 70 of the cabinet 52 along flow path F9.

As shown in FIG. 9, the turbine wheel 260 is positioned at least partially into the flow path F8 such that air is pushed against the turbine wheel 260 as air flows along flow path F8. Air contacts at least one of the plurality of turbine blades 272 and rotates the turbine wheel 260. Rotation of the turbine wheel 260 causes rotation of the turbine wheel shaft 276 and thereby rotation of the at least one component of the turbine wheel motor 262. The turbine wheel motor 262 recovers mechanical energy from the airflow along flow path F8 and converts the recovered mechanical energy into electricity (e.g., current, voltage). Accordingly, the turbine wheel motor 262 acts as a generator, such as a dynamo or a direct current (DC) generator. The electric current may be used to power one or more electrical components of the laundry appliance 50. Examples of the one or more electrical components include the display 73, the speaker 75, the heater 136, or another suitable electrical component.

In some configurations, electric current may be used to determine an amount of lint in the exhaust system 146. With reference to FIGS. 1 and 5, the control module 77 of the laundry appliance 50 is in communication with the turbine wheel motor 262. The control module 77 has a processor and memory and is programmed to measure a voltage of the electric current converted from the recovered mechanical energy. The control module 77 is programmed to determine an amount of airflow exiting the exhaust outlet 70 along flow based on the voltage. The control module 77 may determine the amount of airflow, for example, using one or more equations and/or lookup tables that relate values of voltage to values of the amount of airflow. The control module 77 may be programmed to determine an amount of lint in the exhaust system 146 based on the voltage. For example, lint may be collected in the exhaust duct 148, the removable lint screen 168, or another location of the exhaust system 146. The control module 77 may determine the amount of lint, for example, using one or more equations and/or lookup tables that relate values of the amount of airflow to values of the amount of lint. When the amount of lint in the exhaust system 146 exceeds a threshold amount, the control module 77 may be programmed to send an alert to the user of the laundry appliance 50 to clean the removable lint screen 168 and/or exhaust system 146. The alert may be an audible alert using the speaker 75 of the laundry appliance 50 or a visual alert using the display 73 of the laundry appliance 50.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A vented dryer, comprising:

a cabinet having an exhaust outlet and a cabinet inlet;

a drum rotatably supported within the cabinet and including a laundry compartment positioned inside the drum;

a heater for heating a flow of air that travels through the drum and exits out the exhaust outlet; and an energy harvesting system including a turbine wheel that is rotatably coupled to a turbine wheel motor to recover mechanical energy from the flow of air exiting through the exhaust outlet of the cabinet and convert recovered mechanical energy into electricity.

2. The vented dryer of claim 1, further comprising:

an exhaust system including an exhaust inlet arranged in fluid communication with the laundry compartment of the drum, wherein:

the exhaust system includes an exhaust fan housing and an exhaust fan positioned within the exhaust fan housing, and the exhaust fan pulls air into the exhaust inlet from the laundry compartment of the drum and pushes air out the exhaust outlet.

3. The vented dryer of claim 2, wherein:

the exhaust fan housing includes a recess and the turbine wheel is positioned within the recess.

4. The vented dryer of claim 2, wherein the turbine wheel is positioned between the exhaust fan and the exhaust outlet.

5. The vented dryer of claim 2, wherein the turbine wheel is positioned at least partially below the exhaust fan housing.

6. The vented dryer of claim 1, wherein the turbine wheel is positioned such that the flow of air contacts at least one turbine blade of the turbine wheel, causing the turbine wheel to rotate and wherein rotation of the turbine wheel recovers mechanical energy from the flow of air exiting through the exhaust outlet.

7. The vented dryer of claim 6, wherein the turbine wheel has a rotational axis that is perpendicular to a direction of the flow of air exiting through the exhaust outlet.

8. The vented dryer of claim 1, wherein the turbine wheel is positioned at least partially within the flow of air exiting through the exhaust outlet.

9. The vented dryer of claim 1, wherein the turbine wheel is attached to the turbine wheel motor using a shaft that extends between the turbine wheel and the turbine wheel motor.

10. A laundry appliance, comprising: a cabinet including a cabinet inlet;

a drum rotatably supported within the cabinet and including a laundry compartment positioned inside the drum;

an exhaust system including an exhaust inlet arranged in fluid communication with the laundry compartment of the drum and an exhaust outlet, wherein a flow of air travels through the laundry compartment, through the exhaust system and exits out the exhaust outlet; and an energy harvesting system including a turbine wheel that is rotatably coupled to a turbine wheel motor to recover mechanical energy from the flow of air exiting through the exhaust outlet and convert recovered mechanical energy into electricity.

11. The laundry appliance of claim 10, wherein the exhaust system includes an exhaust fan housing and an exhaust fan positioned within the exhaust fan housing.

12. The laundry appliance of claim 11, wherein the energy harvesting system includes a bracket that has a first bracket portion attached to the exhaust fan housing and a second bracket portion attached to the turbine wheel motor.

13. The laundry appliance of claim 12, wherein the first bracket portion of the bracket includes a bracket recess that at least partially houses the turbine wheel, such that the turbine wheel is positioned at least partially within the flow of air exiting through the exhaust outlet.

14. The laundry appliance of claim 11, wherein the turbine wheel is positioned between the exhaust fan and the exhaust outlet.

15. The laundry appliance of claim 10, wherein the flow of air contacts at least one of a plurality of turbine blades of the turbine wheel and causes the turbine wheel to rotate.

16. The laundry appliance of claim 15, wherein the energy harvesting system includes a shaft coupling the turbine wheel and the turbine wheel motor such that rotation of the turbine wheel causes the shaft to rotate and rotation of the shaft causes the turbine wheel motor to convert the rotation into electricity.

17. A laundry appliance, comprising:

a cabinet having an exhaust outlet and a cabinet inlet;

a drum rotatably supported within the cabinet and including a laundry compartment positioned within the drum;

an exhaust system having a removable lint screen positioned between the laundry compartment and the exhaust outlet, wherein a flow of air travels through the laundry compartment, through the removable lint screen of the exhaust system and exits out the exhaust outlet; and an energy harvesting system including a turbine wheel that is rotatably coupled to a turbine wheel motor to recover mechanical energy from the flow of air exiting through the exhaust outlet of the cabinet and convert recovered mechanical energy into electric current.

18. The laundry appliance of claim 17, further comprising a control module having a processor and memory that is programmed to:

determine a voltage of the electric current converted from the recovered mechanical energy, and determine an amount of lint in the exhaust system based on the voltage of the electric current converted from the recovered mechanical energy.

19. The laundry appliance of claim 18, wherein the control module is programmed to send an alert when the amount of lint exceeds a threshold amount of lint using at least one of a display and a speaker.

20. The laundry appliance of claim 17, wherein the electric current is used to power at least one electrical component of the laundry appliance.

* * * * *